US010830021B2

(12) United States Patent
Fuxa et al.

(10) Patent No.: US 10,830,021 B2
(45) Date of Patent: Nov. 10, 2020

(54) FILTRATION MEDIA FOR AN OPEN HOLE PRODUCTION SYSTEM HAVING AN EXPANDABLE OUTER SURFACE

(71) Applicants: Jason E. Fuxa, Houston, TX (US); Christophe Malbrel, Houston, TX (US); Michael Johnson, Katy, TX (US); Elmer Peterson, Porter, TX (US)

(72) Inventors: Jason E. Fuxa, Houston, TX (US); Christophe Malbrel, Houston, TX (US); Michael Johnson, Katy, TX (US); Elmer Peterson, Porter, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 169 days.

(21) Appl. No.: 16/027,499

(22) Filed: Jul. 5, 2018

(65) Prior Publication Data

US 2020/0011162 A1 Jan. 9, 2020

(51) Int. Cl.
*E21B 43/10* (2006.01)
*E21B 43/08* (2006.01)

(52) U.S. Cl.
CPC ..... *E21B 43/108* (2013.01); *E21B 43/086* (2013.01); *E21B 43/105* (2013.01)

(58) Field of Classification Search
CPC .... E21B 43/108; E21B 43/086; E21B 43/105; B21D 39/04
See application file for complete search history.

(56) References Cited

U.S. PATENT DOCUMENTS 5,667,011 A * 9/1997 Gill ..... E21B 33/14 166/295
5,901,789 A * 5/1999 Donnelly ..... E21B 43/04 166/381
5,924,745 A * 7/1999 Campbell ..... E21B 43/103 285/90
6,315,040 B1 11/2001 Donnelly
6,354,373 B1 * 3/2002 Vercaemer ..... E21B 43/086 166/207
6,457,533 B1 * 10/2002 Metcalfe ..... E21B 33/10 166/207
6,523,611 B1 2/2003 Bakker et al.
6,607,032 B2 * 8/2003 Voll ..... B01D 29/111 166/227
6,904,974 B2 * 6/2005 Slack ..... E21B 43/086 166/207
6,932,159 B2 8/2005 Hovem
(Continued)

OTHER PUBLICATIONS

International Search Report and Written Opinion for International Application No. PCT/US2019/035477; International Filing Date Jun. 5, 2019; Report dated Sep. 25, 2019 (pp. 1-11).

*Primary Examiner* — Michael R Wills, III
(74) *Attorney, Agent, or Firm* — Cantor Colburn LLP

(57) ABSTRACT

A subsurface system includes a tubular having an opening. A filtration media is mounted about the tubular over the opening. The filtration media includes a selectively expandable outer surface positioned over the opening. The selectively expandable outer surface includes one or more selectively expandable openings. The one or more selectively expandable openings transition from a first dimension to a second dimension upon expansion of the selectively expandable outer surface.

13 Claims, 6 Drawing Sheets

(56) References Cited

U.S. PATENT DOCUMENTS

| | | | | |
|---|---|---|---|---|
| 6,932,161 | B2 * | 8/2005 | Cameron | E21B 43/08 166/384 |
| 7,093,653 | B2 | 8/2006 | Metcalfe et al. | |
| 7,134,501 | B2 | 11/2006 | Johnson et al. | |
| 7,543,648 | B2 * | 6/2009 | Hill | E21B 37/08 166/227 |
| 2004/0003927 | A1 * | 1/2004 | Rudd | E21B 43/086 166/382 |
| 2004/0251033 | A1 * | 12/2004 | Cameron | E21B 43/025 166/382 |
| 2004/0261994 | A1 * | 12/2004 | Nguyen | E21B 43/088 166/278 |
| 2005/0121232 | A1 * | 6/2005 | Rudd | B21D 39/04 175/57 |
| 2013/0213638 | A1 * | 8/2013 | Keller | C09K 8/467 166/248 |
| 2016/0326849 | A1 * | 11/2016 | Bruce | E21B 33/14 |

* cited by examiner

FILTRATION MEDIA FOR AN OPEN HOLE PRODUCTION SYSTEM HAVING AN EXPANDABLE OUTER SURFACE

BACKGROUND

In the resource exploration and recovery industry, the formation of boreholes for the purpose of locating and producing fluids typically involves introducing a tubular into a wellbore formed in a formation. The tubular typically includes one or more screen systems that filter produced fluids before passing into the tubular. In open hole or uncased wellbores, drilling mud is typically directed into the wellbore along with the tubular. The drilling mud supports the wellbore and reduces damage to the formation during run in.

In order to reduce clogging of the screen assembly, the drilling mud is processed to remove particles that may be larger than the screen openings. Thus, any filter cake that may form on the screen assembly during run in does not block screen openings and impede production. Processing or conditioning the drilling mud to prevent clogging of the screen assembly is a time consuming and costly process. Therefore, the art would be appreciative of alternatives to conditioning drilling mud used during run in of a production tubular.

SUMMARY

In accordance with an exemplary embodiment, a subsurface system includes a tubular having an opening. A filtration media is mounted about the tubular over the opening. The filtration media includes a selectively expandable outer surface positioned over the opening. The selectively expandable outer surface includes one or more selectively expandable openings. The one or more selectively expandable openings transition from a first dimension to a second dimension upon expansion of the selectively expandable outer surface.

In accordance with another aspect of exemplary embodiment, a resource exploration and recovery system includes a first system, and a second system including a tubular string. The tubular string includes one or more tubulars. One of the one or more tubulars includes an opening. A filtration media is mounted about the tubular over the opening. A selectively expandable outer surface is positioned over the filtration media. The selectively expandable outer surface includes one or more selectively expandable openings. The one or more selectively expandable openings transition from a first dimension to a second dimension upon expansion of the selectively expandable outer surface.

In accordance with yet another exemplary embodiment, a method of producing formation fluids includes introducing a tubular string supporting a filtration media into a wellbore, flowing drilling fluid into the wellbore with the tubular string, positioning the filtration media at a target depth, expanding an outer surface of the filtration media, wherein expansion of the outer surface exposes an opening formed in the tubular to formation fluids, and introducing formation fluids through the outer surface and into the tubular through the opening.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
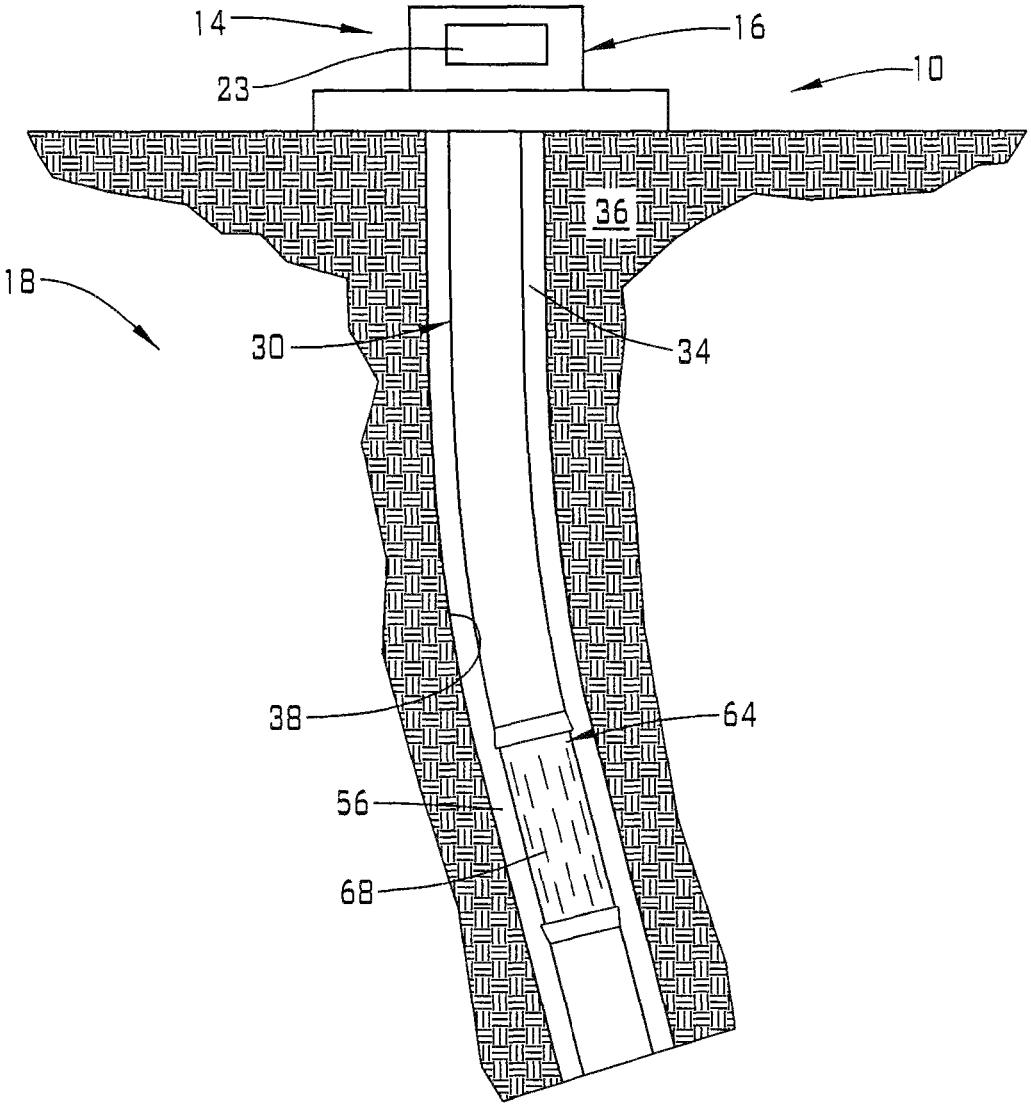
FIG. 1 depicts a resource exploration and recovery system including a filtration media having a selectively expandable cover, in accordance with an exemplary embodiment.

A resource exploration and recovery system, in accordance with an exemplary embodiment, is indicated generally at 10, in FIG. 1. Resource exploration and recovery system 10 should be understood to include well drilling operations, completions, resource extraction and recovery, $CO_2$ sequestration, and the like. Resource exploration and recovery system 10 may include a first system 14 which, in some environments, may take the form of a surface system 16 operatively and fluidically connected to a second system 18 which, in some environments, may take the form of a subsurface system (not separately labeled).

First system 14 may include a control system 23 that may provide power to, monitor, communicate with, and/or activate one or more downhole operations as will be discussed herein. Surface system 16 may include additional systems such as pumps, fluid storage systems, cranes and the like (not shown). Second system 18 may include a tubular string 30 that extends into a wellbore 34 formed in a formation 36. Tubular string 30 may be formed by a series of interconnected discrete tubulars or by a single tubular that could take the form of coiled tubing. Wellbore 34 includes an annular wall 38 defining an open hole configuration.

Figure 2:
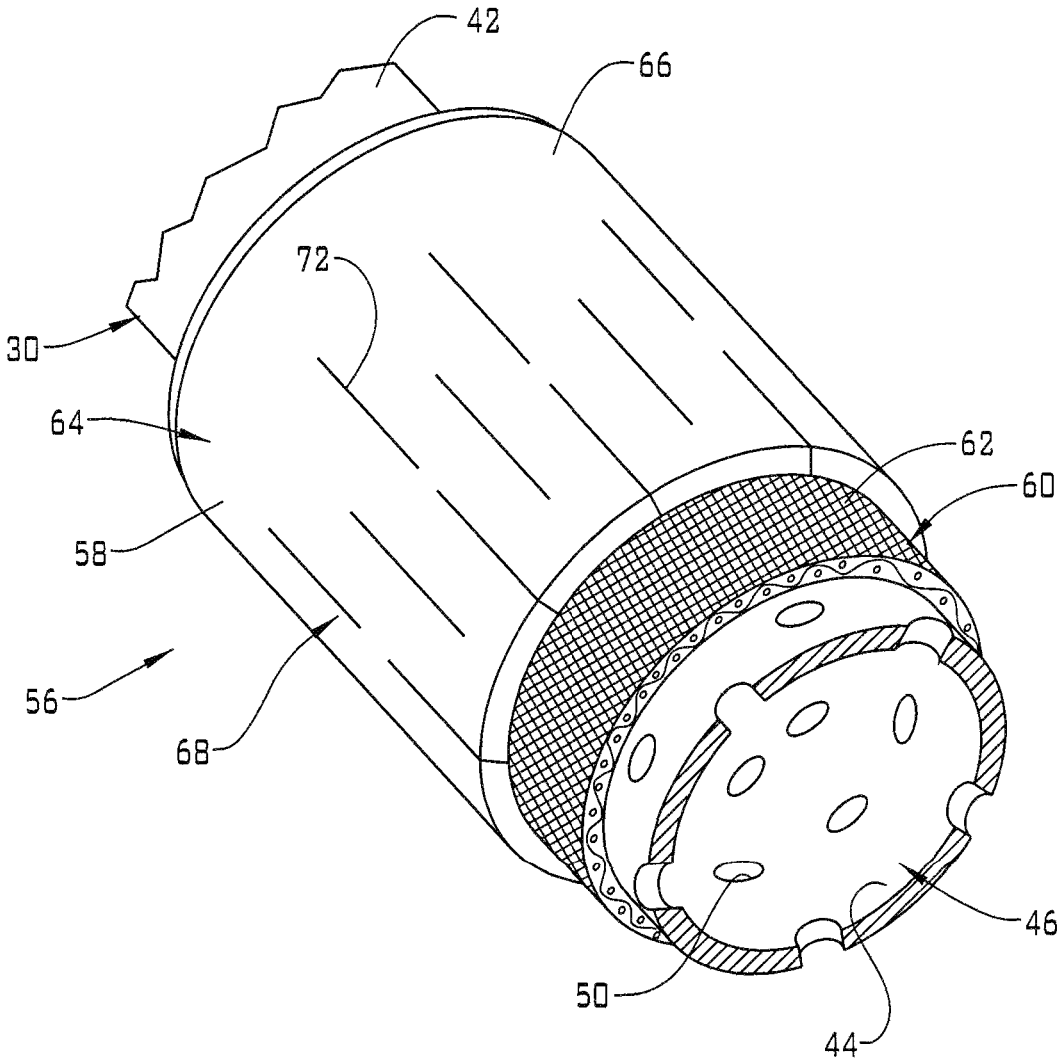
FIG. 2 depicts a cross-section end view of the filtration media and selectively expandable cover in a first configuration, in accordance with an aspect of an exemplary embodiment.

Referring to FIG. 2, and with continued reference to FIG. 1, tubular string 30 includes an outer surface 42 and an inner surface 44 that defines a fluid passage 46. A plurality of openings 50 are provided on a selected region of tubular string 30. The plurality of openings may fluidically connect fluid passage 46 and wellbore 34. A filtration media 56 is provided on tubular string 30 and positioned over a plurality of openings 50. Filtration media 56 includes a selectively expandable outer surface 58, an intermediate layer 60 that may be defined by a mesh layer 62 that filters fluids passing between wellbore 34 and fluid passage 46. Mesh layer 62 may be defined by one or more layers (not shown) of a wire mesh material (not separately labeled). Further, each layer of the wire mesh may include openings having different sizes.

In accordance with one exemplary embodiment, selectively expandable outer surface 58 may be defined by a selectively expandable cover 64. In an embodiment, selectively expandable cover 64 may take the form of a metal sheath 66 that may be caused to increase in diameter. Of course, it should be understood that selectively expandable cover 64 may be formed from other materials. Selectively expandable cover 64 includes a plurality of selectively expandable openings, one of which is indicated at 68. Selectively expandable openings 68 may take the form of slits 72 that extends through selectively expandable cover 64.

Figure 3:
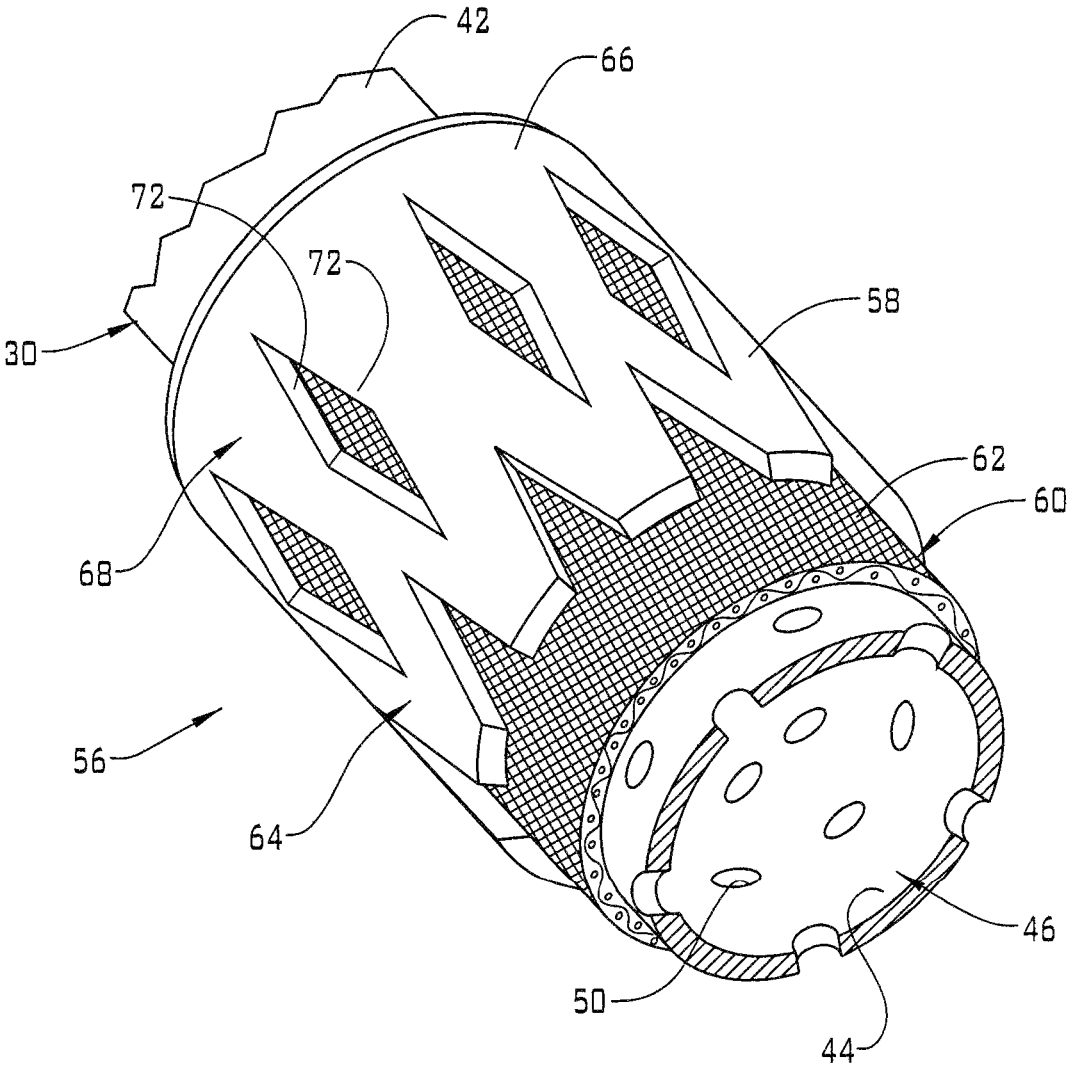
FIG. 3 depicts a cross-section end view of the filtration media and selectively expandable cover in a second configuration, in accordance with an aspect of an exemplary embodiment.

In further accordance with an exemplary embodiment, selectively expandable openings 68 may include a first dimension, such as shown in FIG. 2. As will be detailed herein, after expansion of selectively expandable cover 64, selectively expandable openings may increase in size so as to be defined by a second dimension that is greater than the first dimension, such as shown in FIG. 3. The first dimension may represent a closed configuration. As such, the first dimension may be about 0.0 inches (0.0 cm). The second dimension represents an open configuration. Size of the second dimension may vary.

Figure 4:
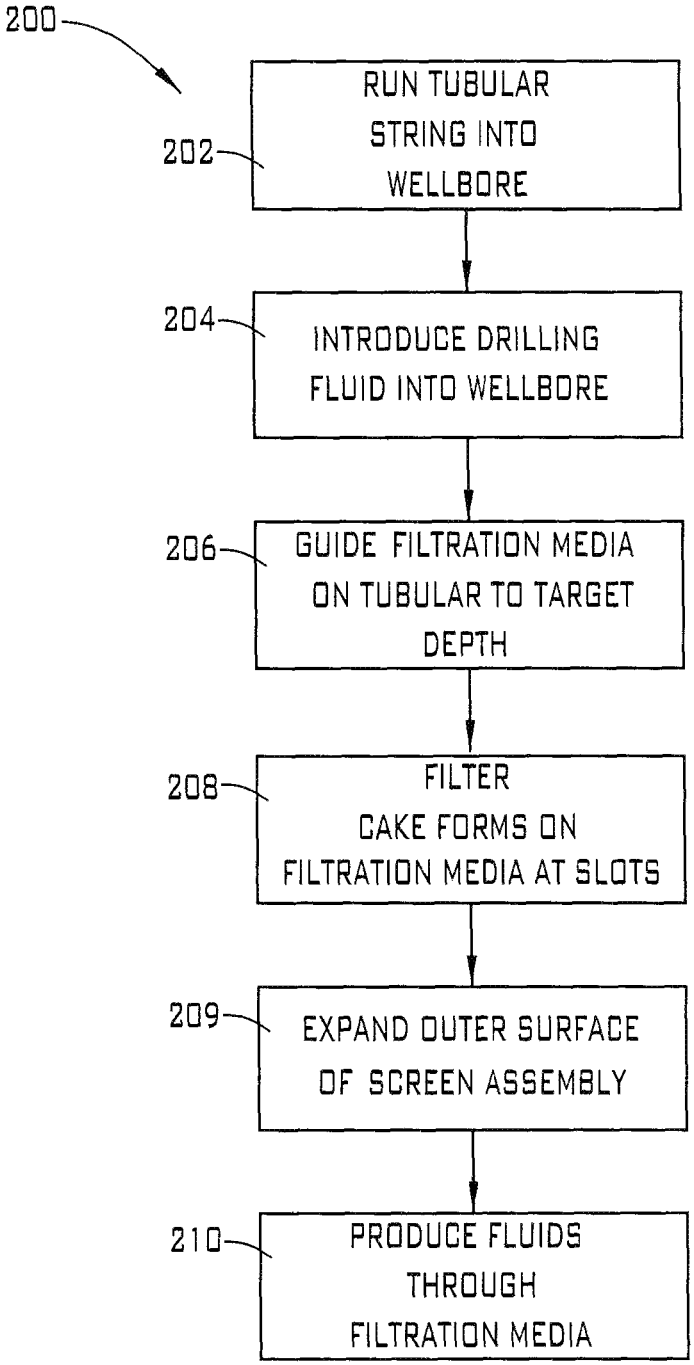
FIG. 4 depicts a flow chart describing a method of producing formation fluids through the filtration media of FIG. 1, in accordance with an exemplary aspect.

Reference will now follow to FIG. 4 in describing a method 200 of producing formation fluids through tubular string 30. Tubular string 30 is run into formation 36 as indicated in block 202. Along with tubular string 30, drilling fluid or mud is introduced into wellbore 34 as indicated in block 204. Filtration media 56 is guided to a target depth as indicated in block 206. At this point, it should be understood that tubular string 30 may support multiple screen assemblies that are delivered to corresponding target depth. One or more screen assemblies may be separated from others of the screen assemblies by packers that form various production zones.

Figure 5:
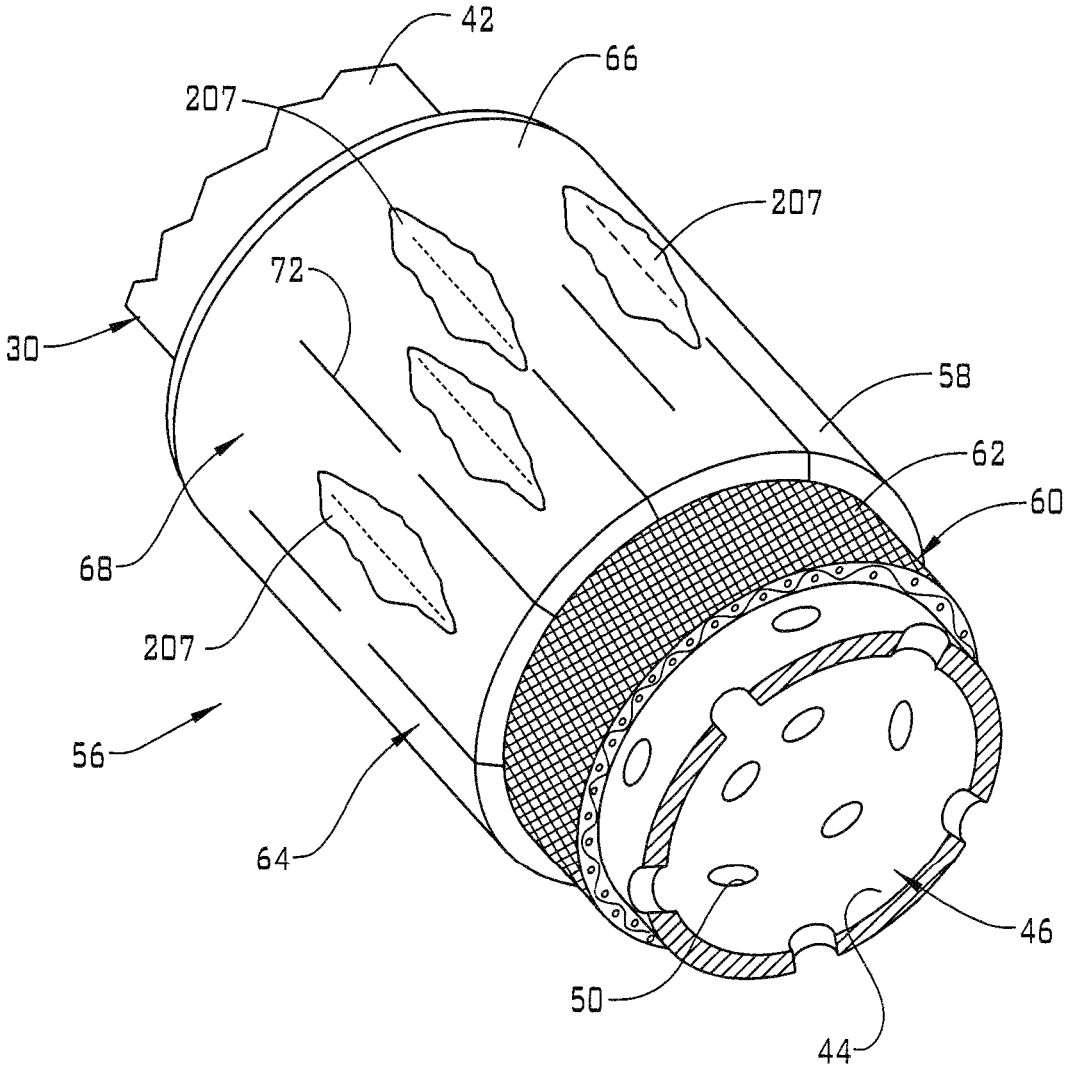
FIG. 5 depicts the filtration media of FIG. 2 including a buildup of filter cake, in accordance with an exemplary aspect.

As tubular string 30 is run into wellbore 34, a filter cake 207, may form on filtration media 56 at slits 72 as indicated in block 208 and shown in FIG. 5. Filter cake may be formed by material in wellbore 34 and or entrained particles in the drilling fluid accumulating on filtration media 56. With slits 72 being substantially closed, only a small portion of particles forming the filter cake 207 may flow through to intermediate layer 60. Once filtration media 56 is at the target depth, selectively expandable cover 64 is radially outwardly expanded as indicated in block 209 thereby opening slits 72 allowing production fluids to pass through filtration media 54 into tubular string 30.

Figure 6:
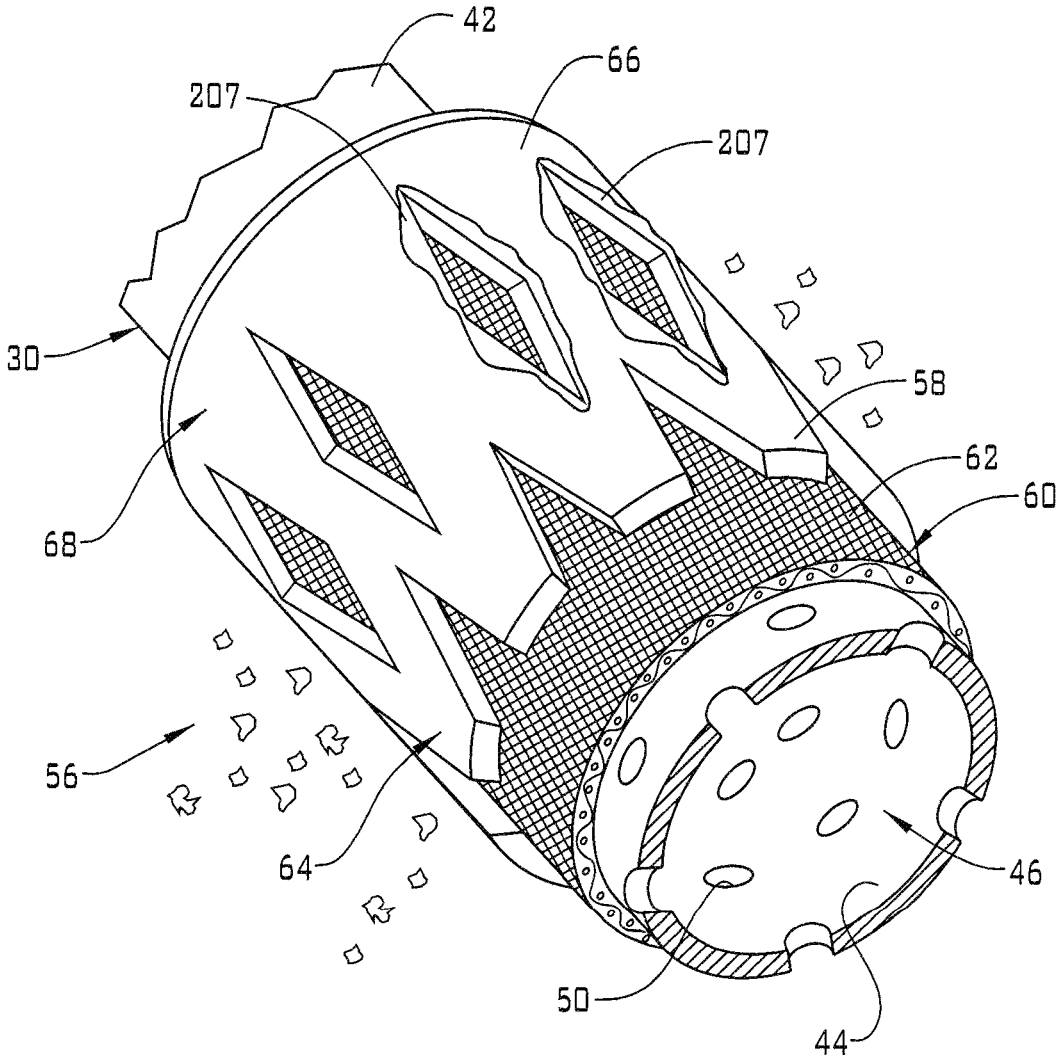
FIG. 6 depicts the filtration media of FIG. 3 with expansion of the selectively expandable cover breaking up the filter cake, in accordance with an exemplary aspect.

For example, a tool (not shown) may be introduced into filtration media 56 to expand selectively expandable cover 64. Alternatively, a release mechanism (also not shown) could be triggered to activate a component run in with tubular string 30 to radially outwardly expand selectively expandable cover 64. Radial outward expansion of selectively expandable cover 64 causes filter cake 207 to break up and be released from filtration media 54 as shown in FIG. 6.

Radial outward expansion of selectively expandable cover 64 also causes selectively expandable openings 68 to transition from the first dimension (FIG. 2) to the second dimension (FIG. 3). In this manner, production fluids may pass through filtration media 56 into fluid passage 46 as indicted in block 210. If any filter cake remains, selectively expandable openings 68 are sized such that particles may pass through cracks or openings (not separately labeled) in filter cake 207 and then through selectively expandable cover 64. Further, production fluids may pass through any cracks or openings formed in any filter cake remaining on filtration media 56. In this manner, operators may no longer need to condition drilling fluids prior to production. That is, selectively expandable cover ensures that filter cake 207, formed by particles in the drilling fluid, is broken up allowing unimpeded flow of formation fluids into tubular string 30.

Set forth below are some embodiments of the foregoing disclosure:

Embodiment 1

A subsurface system including: a tubular including an opening; and a filtration media mounted about the tubular over the opening, the filtration media including a selectively expandable outer surface positioned over the opening, the selectively expandable outer surface including one or more selectively expandable openings, the one or more selectively expandable openings transitioning from a first dimension to a second dimension upon expansion of the selectively expandable outer surface.

Embodiment 2

The subsurface system as any prior embodiment, wherein the selectively expandable outer surface is defined by a selectively expandable cover that extends about the tubular.

Embodiment 3

The subsurface system as any prior embodiment, wherein the selectively expandable cover comprises a metal sheath Embodiment 4

The subsurface system as any prior embodiment, wherein the first dimension is about 0.0 inches (0.0 cm)

Embodiment 5

The subsurface system as any prior embodiment, wherein the one or more selectively expandable openings comprise slits formed in the selectively expandable outer surface Embodiment 6

A resource exploration and recovery system including: a first system; a second system including a tubular string, the tubular string including one or more tubulars, one of the one or more tubulars including an opening; a filtration media mounted about the tubular over the opening; and a selectively expandable outer surface positioned over the filtration media, the selectively expandable outer surface including one or more selectively expandable openings, the one or more selectively expandable openings transitioning from a first dimension to a second dimension upon expansion of the selectively expandable outer surface.

Embodiment 7

The resource exploration and recovery system as any prior embodiment, wherein the selectively expandable outer surface is defined by a selectively expandable cover that extends about the tubular.

Embodiment 8

The resource exploration and recovery system as any prior embodiment, wherein the selectively expandable cover comprises a metal sheath Embodiment 9

The resource exploration and recovery system as any prior embodiment, wherein the first dimension is about 0.0 inches (0.0 cm)

Embodiment 10

The resource exploration and recovery system as any prior embodiment, wherein the one or more selectively expandable openings comprise slits formed in the selectively expandable outer surface.

Embodiment 11

A method of producing formation fluids including: introducing a tubular string supporting a filtration media into a wellbore; flowing drilling fluid into the wellbore with the tubular string; positioning the filtration media at a target depth; expanding an outer surface of the filtration media, wherein expansion of the outer surface exposes an opening formed in the tubular to formation fluids; and introducing formation fluids through the outer surface and into the tubular through the opening.

Embodiment 12

The method as any prior embodiment, wherein expanding of the outer surface forms one or more openings in a cover of the filtration media.

Embodiment 13

The method as any prior embodiment, further including: transitioning the one or more openings from a first dimension prior to expansion of the cover to a second dimension after expansion of the cover.

Embodiment 14

The method as any prior embodiment, wherein transitioning to the second dimension is defined by an increase in size.

Embodiment 15

The method as any prior embodiment, wherein transitioning from the first dimension to the second dimension includes transitioning the one or more openings from a substantially closed configuration to an open configuration after expansion of the outer surface.

Embodiment 16

The method as any prior embodiment, wherein expanding the outer surface includes introducing a tool into the tubular string.

Embodiment 17

The method as any prior embodiment, wherein expanding the outer surface includes triggering a release mechanism in the tubular string.

Embodiment 18

The method as any prior embodiment, wherein expanding the outer surface includes increasing a diameter of a metal sheath.

Embodiment 19

The method as any prior embodiment, wherein expanding the outer surface causes a filter cake adhered to the filtration media to break.

Embodiment 20

The method as any prior embodiment, further including: receiving production fluids into the tubular through cracks in the filter cake.

The terms "about" and "substantially" are intended to include the degree of error associated with measurement of the particular quantity based upon the equipment available at the time of filing the application. For example, "about" and/or "substantially" can include a range of ±8% or 5%, or 2% of a given value.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A subsurface system comprising:

a tubular including an opening; and a filtration media mounted about the tubular over the opening, the filtration media including a selectively expandable outer surface positioned over the opening, the selectively expandable outer surface including one or more selectively expandable openings, the one or more selectively expandable openings transitioning from a first dimension defining a substantially closed configuration having a limited permeability to fluids to a second dimension having an increased permeability to fluids upon expansion of the selectively expandable outer surface.

2. The subsurface system according to claim 1, wherein the selectively expandable outer surface is defined by a selectively expandable cover that extends about the tubular.

3. The subsurface system according to claim 2, wherein the selectively expandable cover comprises a metal sheath.

4. The subsurface system according to claim 1, wherein the one or more selectively expandable openings comprise slits formed in the selectively expandable outer surface.

5. A resource exploration and recovery system comprising:

a surface system;

a subsurface system including a tubular string extending from the surface system, the tubular string including one or more tubulars, one of the one or more tubulars including an opening;

a filtration media mounted about the tubular over the opening; and a selectively expandable outer surface positioned over the filtration media, the selectively expandable outer surface including one or more selectively expandable openings, the one or more selectively expandable openings transitioning from a first dimension defining a substantially closed configuration having a limited permeability to fluids to a second dimension having an increased permeability to fluids upon expansion of the selectively expandable outer surface to a second dimension upon expansion of the selectively expandable outer surface.

6. The resource exploration and recovery system according to claim 5, wherein the selectively expandable outer surface is defined by a selectively expandable cover that extends about the tubular.

7. The resource exploration and recovery system according to claim 6, wherein the selectively expandable cover comprises a metal sheath.

8. The resource exploration and recovery system according to claim 5, wherein the one or more selectively expandable openings comprise slits formed in the selectively expandable outer surface.

9. A method of producing formation fluids comprising:

introducing a tubular string supporting a filtration media into a wellbore;

flowing drilling fluid into the wellbore with the tubular string;

positioning the filtration media at a target depth;

accumulating filter cake on the filtration media;

expanding an outer surface of the filtration media, wherein expansion of the outer surface breaks up the filter cake and transitions an opening formed in the tubular from a first dimension defining a substantially closed configuration having limited permeability to a second dimension having increased permeability to formation fluids; and introducing formation fluids through the outer surface and into the tubular through the opening.

10. The method of claim 9, wherein expanding the outer surface includes introducing a tool into the tubular string.

11. The method of claim 9, wherein expanding the outer surface includes triggering a release mechanism in the tubular string.

12. The method of claim 9, wherein expanding the outer surface includes increasing a diameter of a metal sheath.

13. The method of claim 9, further comprising: receiving production fluids into the tubular through cracks in the filter cake.

* * * * *